US008913932B2

(12) United States Patent
Akamatsu

(10) Patent No.: US 8,913,932 B2
(45) Date of Patent: Dec. 16, 2014

(54) IMAGE FORMING APPARATUS

(71) Applicant: Hidenori Akamatsu, Tokyo (JP)

(72) Inventor: Hidenori Akamatsu, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/022,855

(22) Filed: Sep. 10, 2013

(65) Prior Publication Data

US 2014/0079444 A1 Mar. 20, 2014

(30) Foreign Application Priority Data

Sep. 18, 2012 (JP) ..... 2012-205105

(51) Int. Cl.

*G03G 15/01* (2006.01)
*G03G 15/00* (2006.01)
*G03G 21/20* (2006.01)

(52) U.S. Cl.

CPC ..... *G03G 15/0178* (2013.01); *G03G 15/5058* (2013.01); *G03G 21/20* (2013.01); *G03G 2215/0129* (2013.01); *G03G 2215/0161* (2013.01)

USPC ..... 399/301; 399/97

(58) Field of Classification Search

CPC ..... G03G 15/0178; G03G 15/5058; G03G 2215/0161; G03G 2215/0129; G03G 21/20

USPC ..... 399/301, 44, 97; 347/116

See application file for complete search history.

(56) References Cited

U.S. PATENT DOCUMENTS

| | | | | |
|---|---|---|---|---|
| 7,965,428 | B2 * | 6/2011 | Akamatsu | |
| 2007/0110461 | A1 * | 5/2007 | Yoshida | 399/44 |
| 2007/0160939 | A1 | 7/2007 | Akamatsu | |
| 2007/0242965 | A1 | 10/2007 | Akamatsu | |
| 2012/0229585 | A1 * | 9/2012 | Higashiyama | 347/116 |

FOREIGN PATENT DOCUMENTS

| | | |
|---|---|---|
| JP | 3728152 | 10/2005 |
| JP | 2006-154555 | 6/2006 |

* cited by examiner

*Primary Examiner* — Susan Lee

(74) *Attorney, Agent, or Firm* — Oblon, Spivak, McClelland, Maier & Neustadt, L.L.P.

(57) ABSTRACT

An image forming apparatus includes: image-forming units of multiple colors that form images on an image carrier in such a manner that the images are overlaid on one another, and a determination unit that determines necessity of position alignment correction of an image of each color accompanying image formation in accordance with a degree of change of image formation environment from when correction was executed in the past and a combination of colors used for the image formation.

9 Claims, 12 Drawing Sheets

| COLOR MODE | Y | M | C | K | REMARKS |
|---|---|---|---|---|---|
| FIRST MODE | O | O | | O | STORE CURRENT TEMPERATURE IN EXECUTION HISTORY STORING UNIT WHEN POSITION ALIGNMENT CORRECTION IS PERFORMED IN THIRD MODE |
| SECOND MODE | O | | O | | STORE CURRENT TEMPERATURE IN EXECUTION HISTORY STORING UNIT WHEN POSITION ALIGNMENT CORRECTION IS PERFORMED IN THIRD MODE |
| THIRD MODE | O | O | O | O | - |

| COLOR MODE | Y | M | C | K | S |
|---|---|---|---|---|---|
| FIRST MODE | O | O | O | O | |
| SECOND MODE | O | O | O | O | O |

IMAGE FORMING APPARATUS

CROSS-REFERENCE TO RELATED APPLICATIONS

The present application claims priority to and incorporates by reference the entire contents of Japanese Patent Application No. 2012-205105 filed in Japan on Sep. 18, 2012.

BACKGROUND OF THE INVENTION

1. Field of the Invention

This invention relates to an image forming apparatus for forming images by image-forming units of multiple colors in an overlapping manner on an image carrier.

2. Description of the Related Art

In an image forming apparatus for forming images by image-forming units of multiple colors in an overlapping manner on an image carrier, it has been known in the past to perform position alignment correction for adjusting image-forming timing with the image-forming units of the colors so that the images of respective colors can be overlaid on one another accurately.

In this method of correction, for example, a method is known in which the image-forming unit of each color is caused to form an image of a predetermined pattern for position alignment, and presence/absence of deviation from an appropriate position is found according to the distance between the patterns.

Japanese Laid-open Patent Publication No. 2001-92202 describes that, in a full-color image forming apparatus having image-forming units of four-color of YMCK, when the full-color image forming apparatus has a single-color mode and a full-color mode, and when it becomes necessary to perform position alignment correction, the correction is made after changing into the full-color mode.

With the method described in Japanese Laid-open Patent Publication No. 2001-92202, the position alignment correction can be performed reliably without relying on the selected mode, but the toners of all the colors are consumed, and in addition, the length of the position alignment pattern is also long, and therefore, there is a problem in that it takes much time in the correction.

There is a need to solve such problem and reduce the image forming material such as the toner and the time required in the position alignment of the images of multiple colors.

SUMMARY OF THE INVENTION

It is an object of the present invention to at least partially solve the problems in the conventional technology.

An image forming apparatus includes: image-forming units of multiple colors that form images on an image carrier in such a manner that the images are overlaid on one another, and a determination unit that determines necessity of position alignment correction of an image of each color accompanying image formation in accordance with a degree of change of image formation environment from when correction was executed in the past and a combination of colors used for the image formation.

An image forming method includes: forming images of multiple colors on an image carrier in such a manner that the images are overlaid on one another, and determining necessity of position alignment correction of an image of each color accompanying image formation in accordance with a degree of change of image formation environment from when correction was executed in the past and a combination of colors used for the image formation.

An image forming apparatus includes: means for forming images of multiple colors on an image carrier in such a manner that the images are overlaid on one another, and a means for determining necessity of position alignment correction of an image of each color accompanying image formation in accordance with a degree of change of image formation environment from when correction was executed in the past and a combination of colors used for the image formation.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, embodiments for carrying out this invention will be specifically explained on the basis of drawings.

Figure 1:
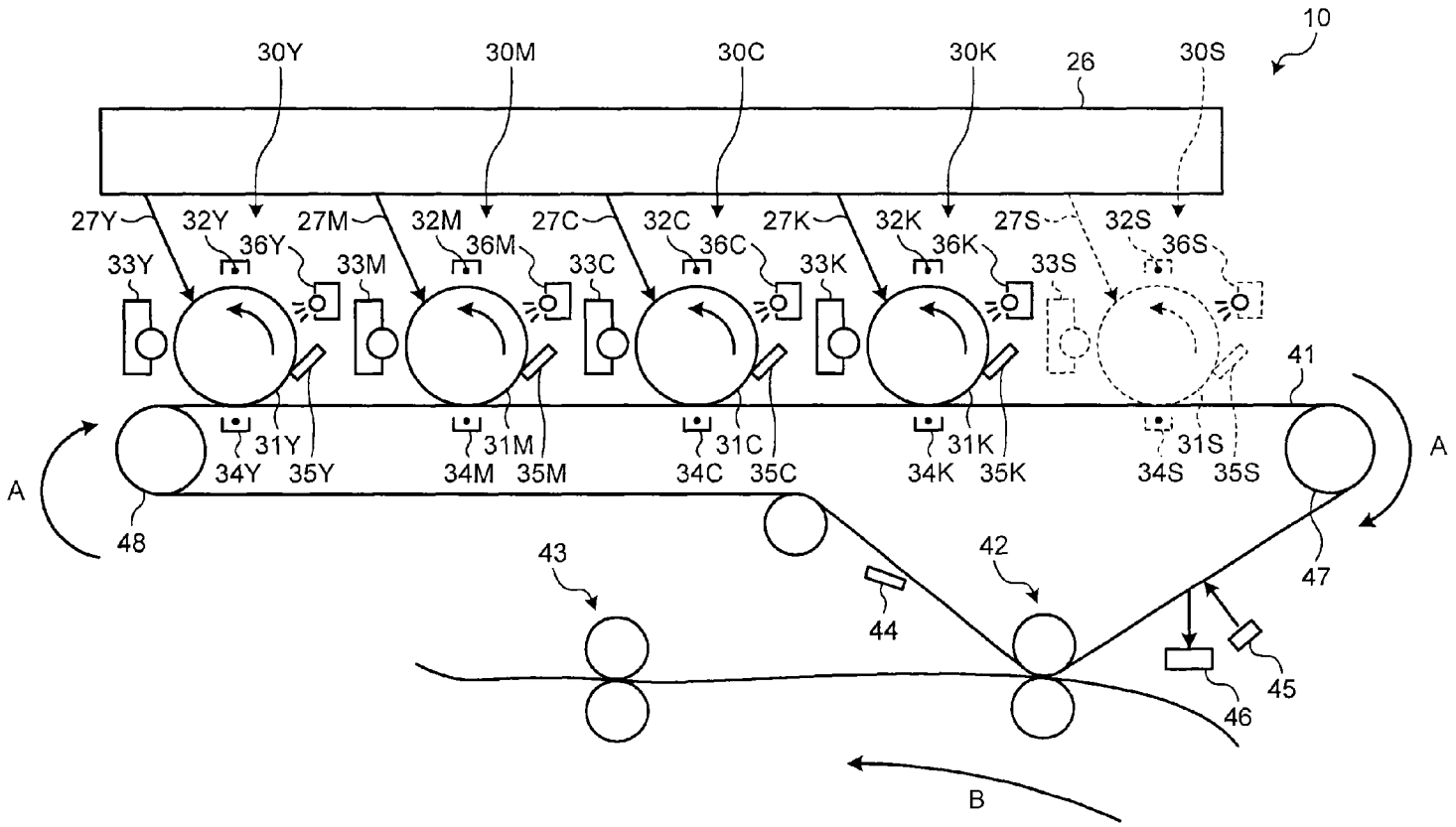
FIG. 1 is a figure schematically illustrating a configuration of an image-forming engine in an image forming apparatus according to an embodiment of this invention.

FIG. 1 is a figure schematically illustrating a configuration of an image-forming engine in an image forming apparatus according to an embodiment of this invention.

As illustrated in FIG. 1, an image forming apparatus 10 includes image-forming units 30Y (yellow), 30M (magenta), 30C (cyan), 30K (black), 30S (special color) of respective colors which are arranged along an intermediate transfer belt 41. The special color is a color that gives special effect to an image such as gloss and gold. In the specific embodiments explained below, there are not only embodiments related to a configuration including a special color but also embodiments related to a configuration not including a special color, and therefore, in FIG. 1, an image-forming unit 30S is depicted with a broken line.

The intermediate transfer belt 41 is an endless belt-shaped image carrier wound around a rotationally driven roller of a secondary transfer unit 42 and tension rollers 47, 48, and is driven to rotate in a clockwise direction as illustrated with arrow A. Polyimide materials are often used as a material of the intermediate transfer belt 41.

The image-forming unit 30Y includes a photosensitive element 31Y, and a charging device 32Y, an exposure device 26, a developing unit 33Y, a primary transfer device 34Y, a cleaning device 35Y, and a neutralization device 36Y, which are arranged around the photosensitive element 31Y.

The exposure device 26 is configured to emit laser lights 27Y, 27M, 27C, 27K, 27S, which are exposure light modulated in accordance with image data corresponding to image colors formed by the image-forming units 30Y, 30M, 30C, 30K, 30S, onto corresponding photosensitive elements 31Y, 31M, 31C, 31K, 31S. Instead of the laser light, it is possible to use light source based on LED (light emitting diode) and EL (electroluminescence).

Multiple image-forming units 30Y, 30M, 30C, 30K, 30S have the same internal configuration except that they are different in the color of a formed toner image. Here, only the members constituting the yellow image-forming unit 30Y are enumerated, but members constituting the other image-forming units are also denoted with the same reference numerals except that the alphabetical portion is different. In the explanation below, when it is not necessary to particularly distinguish the colors, reference symbols without alphabets are used.

When an image is formed, this image forming apparatus 10 uniformly charges the external peripheral surface of the photosensitive element 31Y using the charging device 32Y in the darkness, and thereafter, forms an electrostatic latent image by exposing it with the laser light 27Y emitted by the exposure device 26. The developing unit 33Y visualizes the electrostatic latent image using toner, and forms a yellow toner image on the photosensitive element 31Y.

At a position (primary transfer position) where the photosensitive element 31Y is in contact with the intermediate transfer belt 41, the toner image is transferred onto the intermediate transfer belt 41 with the operation of the primary transfer device 34Y. In this transfer process, the toner image is formed onto the intermediate transfer belt 41. After the transfer of the toner image is finished, unnecessary toner remaining on the external peripheral surface of the photosensitive element 31Y is cleaned by the cleaning device 35Y, and thereafter, the photosensitive element 31Y is kept waiting for a subsequent image forming process. Possible examples of cleaning device 35Y include a cleaning blade and a cleaning brush.

The intermediate transfer belt 41 onto which the toner image is transferred by the image-forming unit 30Y in the way described above is carried to the subsequent image-forming unit 30M. Although not explained in detail, the image-forming unit 30M transfers a magenta image in an overlapping manner on the image formed on the intermediate transfer belt 41 using processing similar to the image forming processing in the image-forming unit 30Y. The intermediate transfer belt 41 is further transferred to subsequent image-forming units 30C, 30K, 30S, and with the similar operation, images in cyan, black, and special color are transferred in an overlapping manner onto the intermediate transfer belt 41. In this manner, full-color and special color images are formed on the intermediate transfer belt 41. The full-color overlapped image formed on the intermediate transfer belt 41 is carried to the position of the secondary transfer device 42.

On the other hand, when an image is formed, sheets which are sheet-like ultimate image carriers accommodated within a paper feed tray, not illustrated, are fed with paper feeding rollers in order such that the uppermost sheet is fed first, and are provided to the secondary transfer device 42 such that the positions thereof are matched with the toner image on the intermediate transfer belt 41.

On this sheet, the toner image on the intermediate transfer belt 41 is transferred by the secondary transfer device 42, and thereafter, the toner image is fixed with heat and pressure by the fixing device 43, and the sheet is discharged out of the image forming apparatus 10.

At the downstream of the secondary transfer device 42, the cleaning device 44 is provided to remove toner remaining on the intermediate transfer belt 41 after the secondary transfer.

Further, in proximity to the intermediate transfer belt 41, a light source 45 and a toner mark sensor 46 are provided to detect a position alignment mark used for position alignment correction of the color images explained later.

The light source 45 emits light onto the position alignment mark formed on the intermediate transfer belt 41, and the toner mark sensor 46 detects the reflected light or the diffused light, whereby the amount of deviation of the image-forming position of each color can be detected from the detection timing. The light source 45 and the toner mark sensor 46 explained above can be arranged anywhere as long as they are located between the primary transfer device 34S (or 34K) at the final stage and the cleaning device 44.

Figure 2:
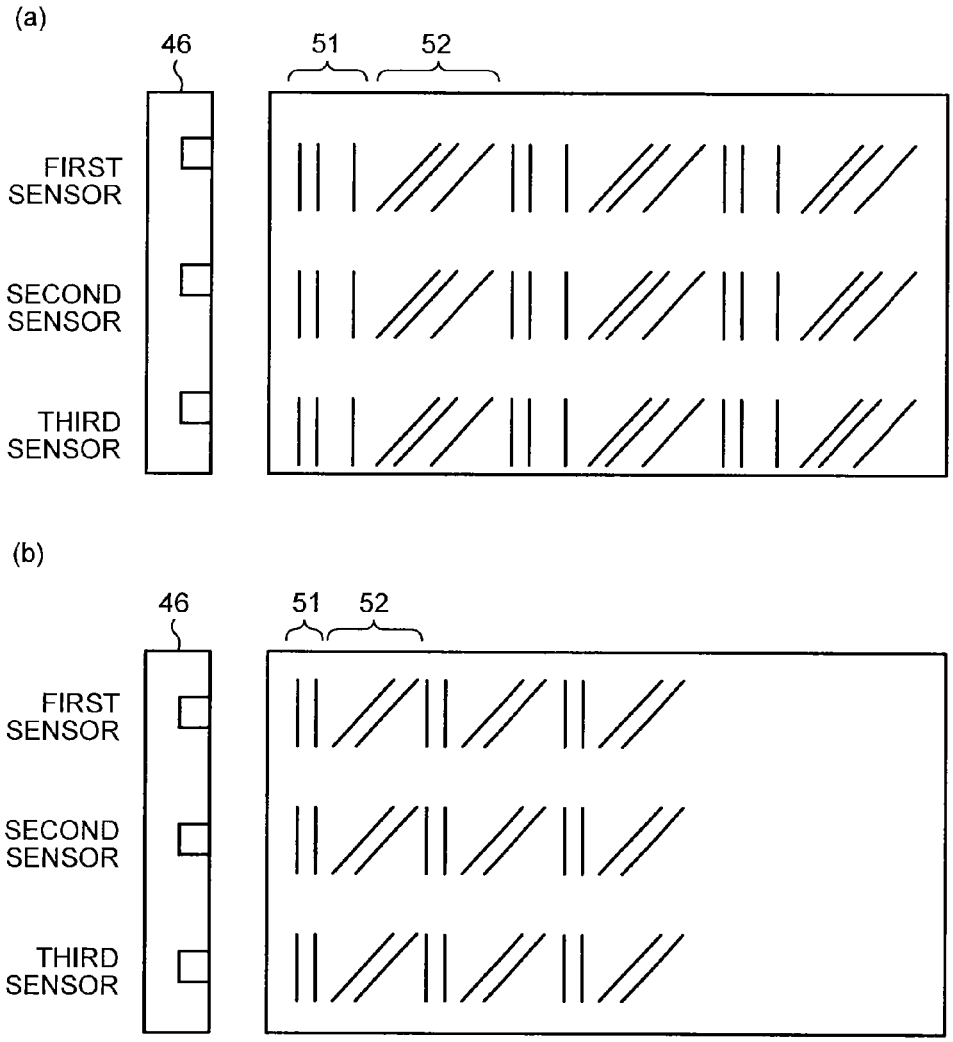
FIG. 2 is a figure illustrating an example of position alignment marks which an image forming apparatus as illustrated in FIG. 1 uses for position alignment correction.

FIG. 2 illustrates an example of position alignment mark.

As illustrated in FIG. 2, the position alignment mark used for position alignment correction in the image forming apparatus 10 is made by alternately forming a mark 51 of a parallel line (a vertical line in the figure) and a mark 52 of a diagonal line to the main-scanning direction, which are alternately formed. The position of the mark of each color is slightly shifted from each other. The toner mark sensor 46 includes three sensors, i.e., first to third sensors, and the formation is made at a position corresponding to each sensor.

Then, by measuring intervals of the vertical lines and the diagonal line of the marks, it is possible to calculate the amounts of corrections for correcting the deviations in the image-forming position in the main-scanning direction, main scanning direction magnification error deviation, the image-forming position in the sub-scanning direction, the skew, and the turn.

In the example of FIG. 2(*a*), the position alignment marks are formed for four colors of YMCK. In the example of FIG. 2(*b*), the position alignment marks are formed for two colors of MK. As can be seen from these examples, it is not necessary to form the position alignment marks for all the colors, and it is sufficient to form only the marks for the colors for which the position alignment correction is done. As can be seen from the comparison between FIGS. 2(*a*) and 2(*b*), when there are a few colors for which the marks are formed, the space corresponding to the color for which the mark is not formed is not leaved to close the marks. Therefore, when the number in colors for which the marks are formed is smaller, the overall length of the pattern becomes shorter, and this makes it possible to do the correction in a short time, and moreover, reduce the total amount of used toner.

Subsequently, a configuration of control system of the image forming apparatus according to the embodiment will be illustrated in FIG. 3.

Figure 3:
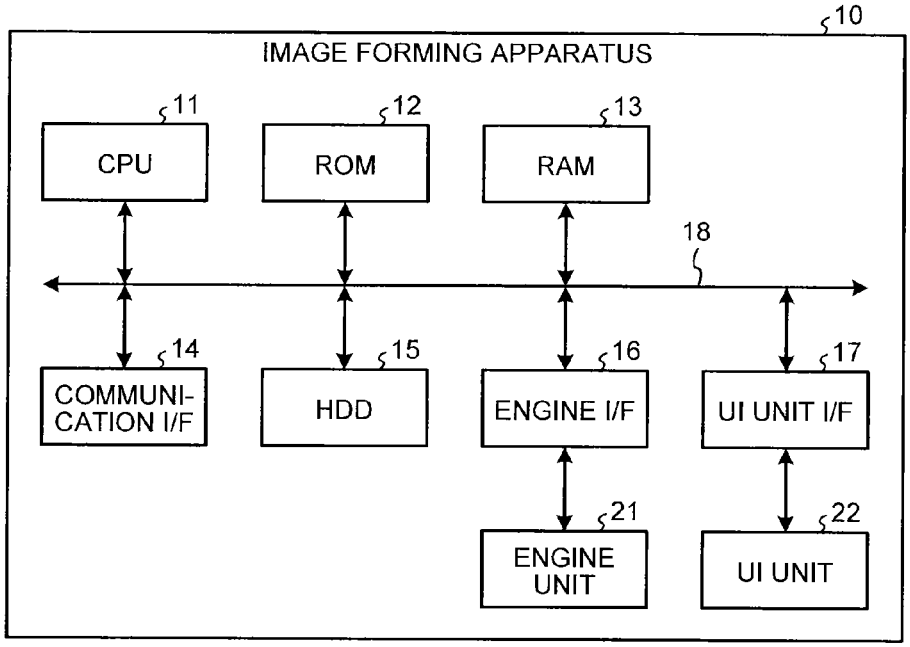
FIG. 3 is a figure illustrating a configuration of a control system of the image forming apparatus as illustrated in FIG. 1.

As illustrated in FIG. 3, the image forming apparatus 10 includes a CPU 11, a ROM 12, a RAM 13, a communication I/F 14, an HDD (hard disk drive) 15, an engine I/F (interface) 16, a UI (user interface) unit I/F 17, which are connected via a system bus 18. An engine unit 21 is connected to the engine I/F 16, and a UI unit 22 is connected to the UI unit I/F 17.

The CPU 11 executes the program stored in the ROM 12 or the HDD 15 using the RAM 13 as a work area, whereby the overall operation of the image forming apparatus 10 is controlled, and various functions such as the control of the position alignment correction explained later can be realized.

The communication I/F 14 is an interface for communicating with an external apparatus such as a PC (personal computer) and a server apparatus via a network such as a LAN (local area network).

The engine unit 21 represents units for performing physical output, other than communication and display, to the external device such as the image-forming engine as illustrated in FIG. 1.

The engine I/F 16 is an interface for connecting the engine unit 21 and the CPU 11 so as to allow the engine unit 21 to be controlled by the CPU 11.

The UI unit I/F 16 is an interface for connecting the UI unit 22 and the CPU 11 so as to allow the UI unit 22 to be controlled by the CPU 11.

The UI unit 22 is an operation receiving unit including a display unit for presenting information to a user and an operating unit for receiving operation of the user. It is to be understood that an external operating unit and/or an external display unit may be used.

It is to be understood that user's operation may be received by receiving data representing the operation content from an external apparatus. Information may be presented to the user by transmitting data representing the display content on the screen or data which are to be displayed on a screen to the external apparatus.

In the image forming apparatus 10 as described above, the distinctive characteristics are the function related to the position alignment correction of each color as explained with reference to FIG. 2. Accordingly, this feature will be hereinafter explained.

Figure 4:
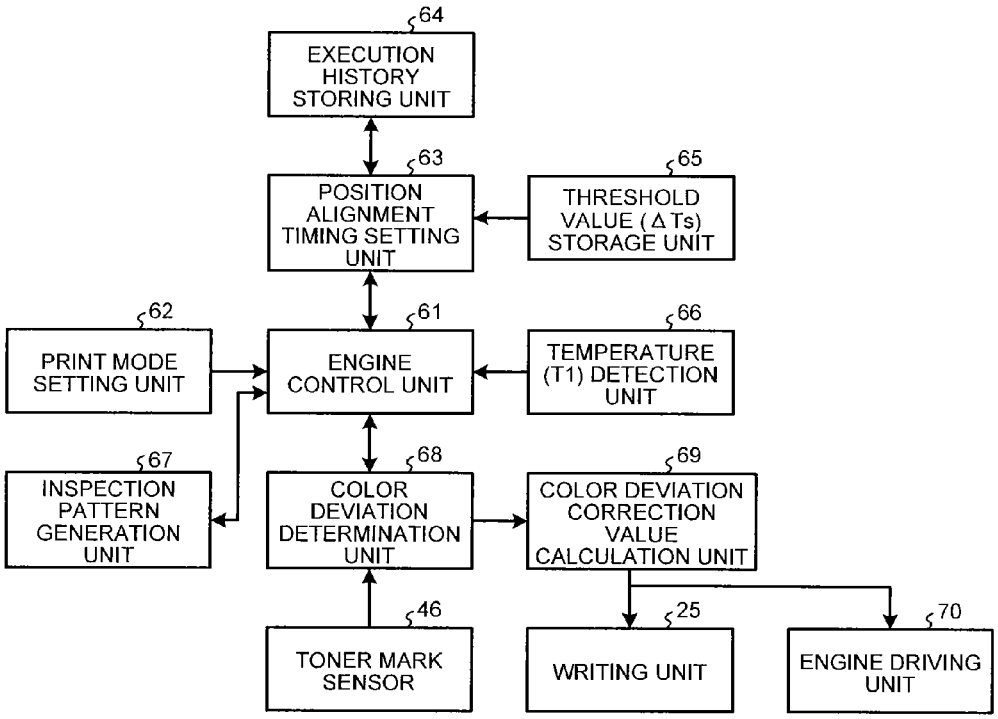
FIG. 4 is a figure illustrating a configuration of functions related to position alignment correction provided in the image forming apparatus as illustrated in FIG. 1.

First, FIG. 4 illustrates a configuration of functions related to position alignment correction provided in the image forming apparatus as illustrated in FIG. 1.

As illustrated in FIG. 4, the image forming apparatus 10 includes a writing unit 25, a toner mark sensor 46, an engine control unit 61, a print mode setting unit 62, a position alignment timing setting unit 63, an execution history storing unit 64, a threshold value storage unit 65, a temperature detection unit 66, an inspection pattern generation unit 67, a color deviation determination unit 68, a color deviation correction value calculation unit 69, an engine driving unit 70, as the functions related to the position alignment correction.

Among them, the toner mark sensor 46 is what has been explained with reference to FIG. 1.

The writing unit 25 is a writing unit having the exposure device 26 as illustrated in FIG. 1.

The engine control unit 61 has a function of controlling the operation of the engine unit 21 as illustrated in FIG. 3, and also centrally controls the operation of each unit regarding the position alignment correction.

When the engine unit 21 is caused to execute image formation, the print mode setting unit 62 sets the print mode including designation in colors used for image formation with respect to the engine control unit 61, and provides the engine control unit 61 with image data required for printing.

In accordance with the setting, the engine control unit 61 causes the position alignment timing setting unit 63 to determine necessity of the position alignment correction, and when it is determined to be necessary, causes the engine unit 21 to execute the position alignment correction. Thereafter, in accordance with the set print mode, the engine unit 21 is controlled to perform image formation according to the image data provided from the print mode setting unit 62.

In response to the request from the engine control unit 61, the position alignment timing setting unit 63 determines whether it is necessary to perform the position alignment correction or not at that moment, and if it is to be performed, the position alignment timing setting unit 63 determines for which color it is necessary to perform the position alignment correction. This determination is made based on the set print mode, data about image formation environment during execution of correction in the past which are stored in the execution history storing unit 64, a threshold value $\Delta Ts$ of temperature difference stored in the threshold value storage unit 65, and a current temperature T1 measured by the temperature detection unit 66. Several examples of detailed procedure of the determination will be illustrated below.

The execution history storing unit 64 is a storage unit for storing information about image formation environment of the engine unit 21 when the position alignment correction is done in the past. In this case, a temperature measured by the temperature detection unit 66 during execution of the correction is stored as the information about the image formation environment. The storage format of the temperature may be in various formats, but several examples will be illustrated below in association with determination method of position alignment correction necessity. This execution history storing unit 64 may be considered to be provided in the RAM 13 or the HDD 15.

The threshold value storage unit 65 stores a threshold value $\Delta Ts$ indicating a degree of change in the image formation environment (in this case, the temperature detected by the temperature detection unit 66) with respect to the image formation environment during execution of the correction in the past which is used to determine that new position alignment correction is to be performed when the degree of change occurs. This threshold value is basically set by a manufacturer of the image forming apparatus 10, but may be configured to allow a user or a maintenance staff member to change the threshold value.

The temperature detection unit 66 is a temperature detection unit measuring the temperature at an appropriate position inside of the image forming apparatus 10 as information representing the image formation environment of the engine unit 21 which affects the image-forming position with the image-forming unit 30 of each color. For example, the temperature detection unit 66 may be constituted by a thermistor.

The inspection pattern generation unit 67 has a function of generating image data of inspection pattern including the position alignment mark as illustrated FIG. 2 which are formed by the image-forming units 30 of respective colors, and providing the image data to the engine control unit 61 when the position alignment correction is executed.

The color deviation determination unit 68 has a function of determining presence/absence of positional deviation of each color, on the basis of the detection result of the mark with the toner mark sensor 46 when the position alignment correction is executed. Further, the color deviation determination unit 68 has a function of providing the data of the detection result to the color deviation correction value calculation unit 69 to cause the color deviation correction value calculation unit 69 to calculate the value of the correction parameter for correcting the positional deviation of each color when there is positional deviation.

The color deviation correction value calculation unit 69 calculates the value of the correction parameter and provides it to the writing unit 25 and the engine driving unit 70 to adjust the image-forming position and the image-forming timing in such a manner that the images of respective colors are overlaid on one another and formed at a desired position.

The engine driving unit 70 has a function of matching the positions of the sheet and the image on the intermediate transfer belt 41 by adjusting the driving timing and the driving speed of the rollers of the secondary transfer device 42 and a registration roller, not illustrated.

Figure 5:
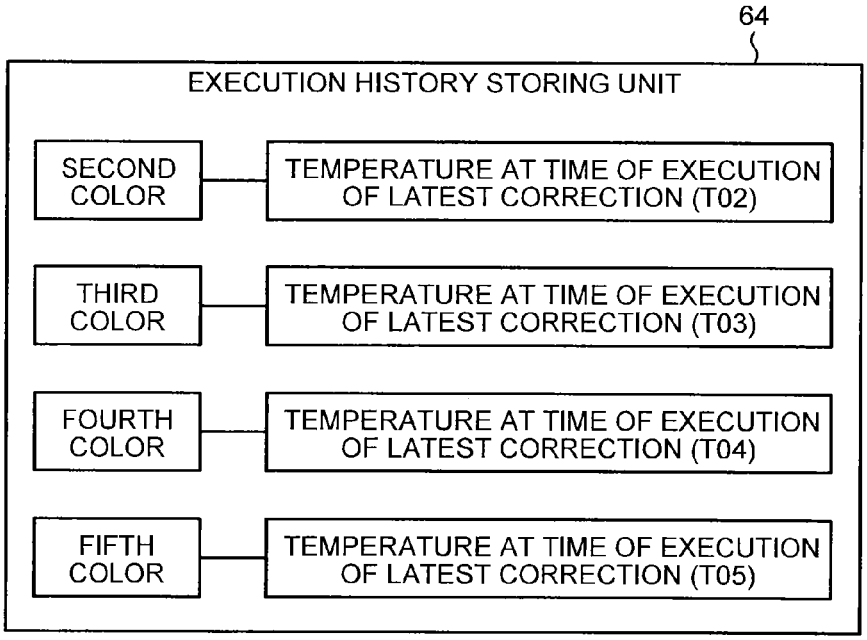
FIG. 5 is a figure illustrating an example of history stored in an execution history storing unit according to a first example of position alignment correction necessity determination.
Figure 6:
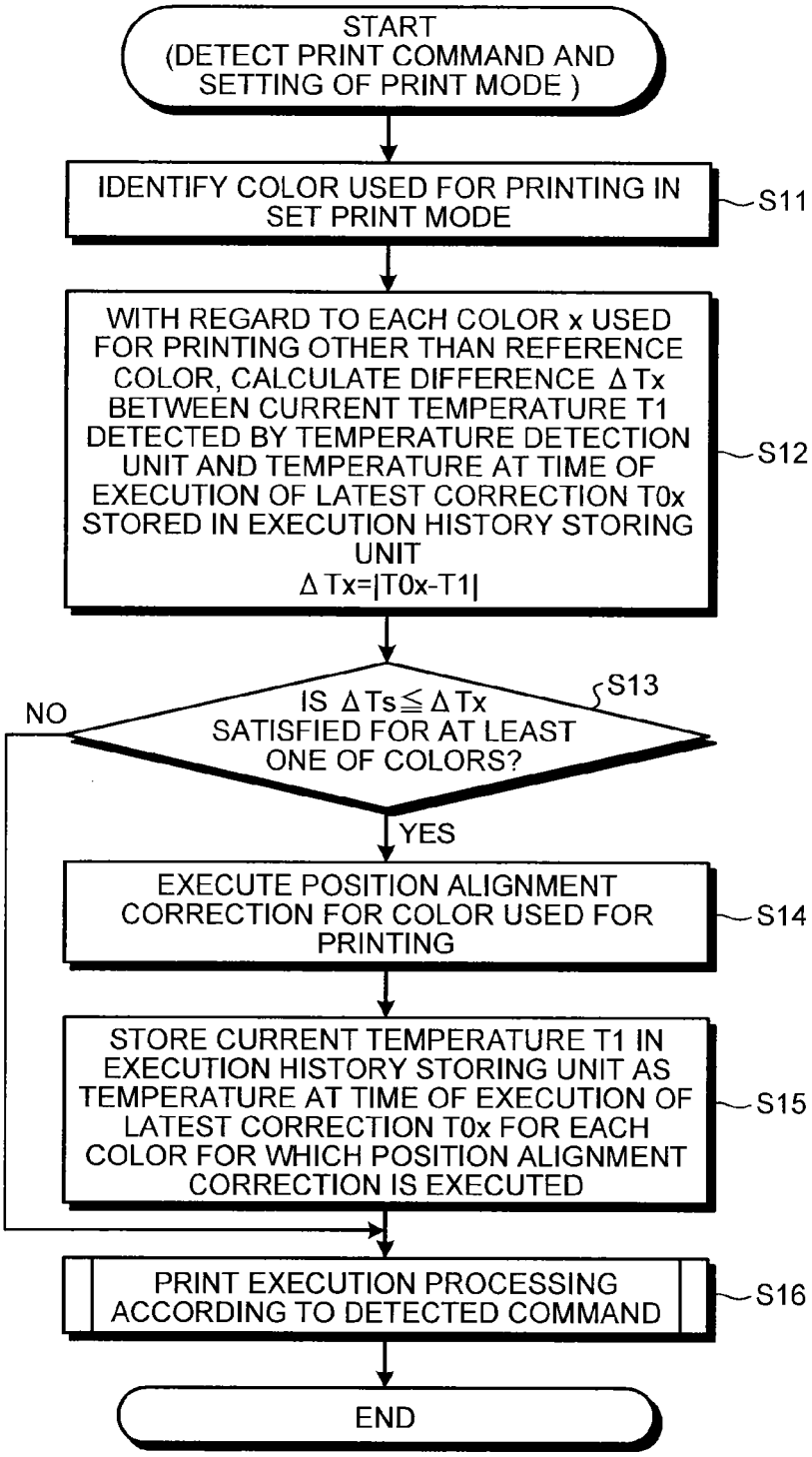
FIG. 6 is a flowchart illustrating processing related to position alignment correction according to the first example.

First Example of Position Alignment Correction Necessity Determination: FIGS. 5 and 6

Subsequently, the first example of the position alignment correction necessity determination with the position alignment timing setting unit 63 will be explained. Together with this, the management method of the history with the execution history storing unit 64 will also be explained. The first example relates to a case where the image forming apparatus 10 includes five image-forming units, i.e., YMCKS.

FIG. 5 illustrates an example of history stored in an execution history storing unit according to the first example.

In the first example, black (K) is adopted as a reference color (the first color), and the image-forming positions of the other four colors, i.e., YMCS (the second to fifth colors, arrangement of which is not limited) are aligned with the position of the image of the reference color being adopted as the reference. For this reason, the position alignment of K is not necessary.

Then, the temperatures detected by the temperature detection unit 66 when the position alignment corrections for the other four colors were done last time are respectively stored as temperatures at the time of execution of the latest corrections T02 to T05.

Subsequently, FIG. 6 illustrates a flowchart of processing related to position alignment correction executed by the CPU 11 according to the first example. This processing is processing corresponding to the functions of the engine control unit 61 and the position alignment timing setting unit 63.

When the CPU 11 detects a print command and setting of print mode used for printing according to the print command, the CPU 11 starts processing as illustrated in the flowchart of FIG. 6.

Then, first, colors used in the printing in the set print mode are identified (S11). The correspondence between the print mode and the colors used for printing is stored in advance separately.

Subsequently, with regard to each color x other than the reference color used for printing, the CPU 11 calculates a difference ΔTx between a current temperature T1 detected by the temperature detection unit 66 and a temperature T0x during execution of the latest correction stored in the execution history storing unit 64 (S12). The following expression holds: $\Delta Tx=|T0x-T1|$.

Then, a determination is made as to whether at least one of the colors satisfies $\Delta Ts \leq \Delta Tx$ (S13). ΔTs is a threshold value stored in the threshold value storage unit 65.

When the result of the determination is NO, then, it can be determined that, for all the colors used for printing other than the reference color, the change of the image formation environment (in this case, temperature) from when the latest corrections for the colors were executed to the present moment is within a predetermined range, and therefore, it is determined that the position alignment correction accompanying the current printing is not necessary. Then, the print execution processing according to the detected print command is performed (S16), and the processing is terminated.

This is because the environment regarding the color used for printing has not yet greatly changed from when the last position alignment was performed, and therefore, the result is determined to be usable again. The position alignment of each color is done with respect to the position of the reference color, and therefore, it is not necessary to consider the position alignment between colors other than the reference color. Therefore, no problem would be caused even if results of position alignment corrections at different points in time are used for the respective colors x. The current printing is not affected by the colors other than the colors used for the printing even if the positional deviation occurs, and therefore, they can be disregarded.

On the other hand, when YES in step S13, the temperature of at least one color among the colors used for printing (other than the reference color) has been changed greatly from when the latest correction was executed to the present moment, and accordingly, it is understood that the positional deviation may occur.

Therefore, the position alignment correction is executed for the colors used for printing in the set print mode (S14). At this moment, when all the colors of YMCKS are not used for printing, then it is not necessary to form position alignment marks for the colors which are not used for printing. As illustrated in FIG. 2(*b*), it is not necessary to leave a vacant space for the color for which the mark is not formed, and the marks are formed only for the colors for which the position alignment is done, without leaving redundant space therebetween. Then, the value of the correction parameter is generated and set as necessary from the detection signal of the mark with the toner mark sensor 46, and when the position alignment is finished, the processing proceeds to step S15.

Then, the current temperature T1 detected with the temperature detection unit 66 is stored in the execution history storing unit 64 as a temperature at the time of execution of the latest correction T0x for each color for which the position alignment correction is executed (S15), and the processing proceeds to the print execution processing (S16).

In the above processing, steps S12 and S13 are the processing corresponding to the function of the determination unit, and step S15 is the processing corresponding to the function of the storing unit.

According to the above processing, a determination can be made as to whether the position alignment correction is needed or not on the basis of steps S12 and S13, whereby the case where printing is affected by the deviation is appropriately determined in accordance with the combination of colors used for printing and the degree of change of the image formation environment from when the correction was executed in the past, so that the positional deviation correction can be done appropriately. Therefore, the toner and the time required for the position alignment correction can be reduced. In addition, the correction is performed only for the colors used for printing, and this means that the correction is not performed even for the colors that do not affect the deviation, and also with regard to this point, the toner and the time required for the position alignment correction can be reduced.

Figures 7, 8:
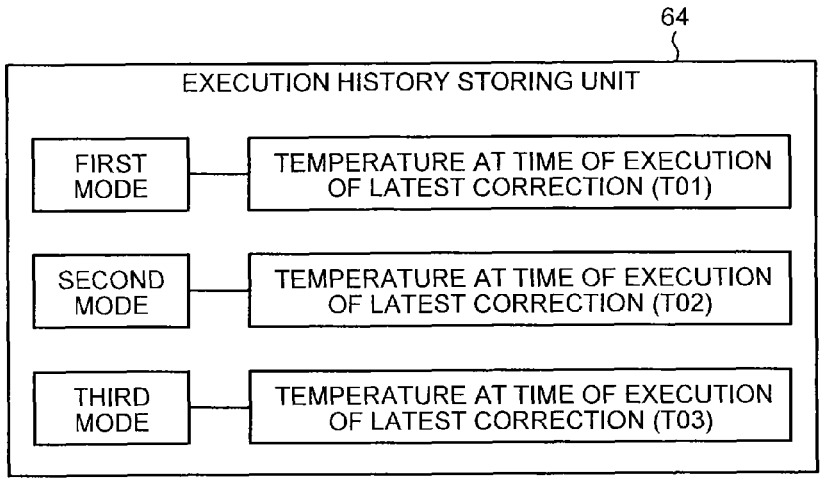
FIG. 7 is a figure illustrating an example of history stored in an execution history storing unit according to a second example of position alignment correction necessity determination.
FIG. 8 is a figure illustrating prepared print modes in the second example.
Figure 9:
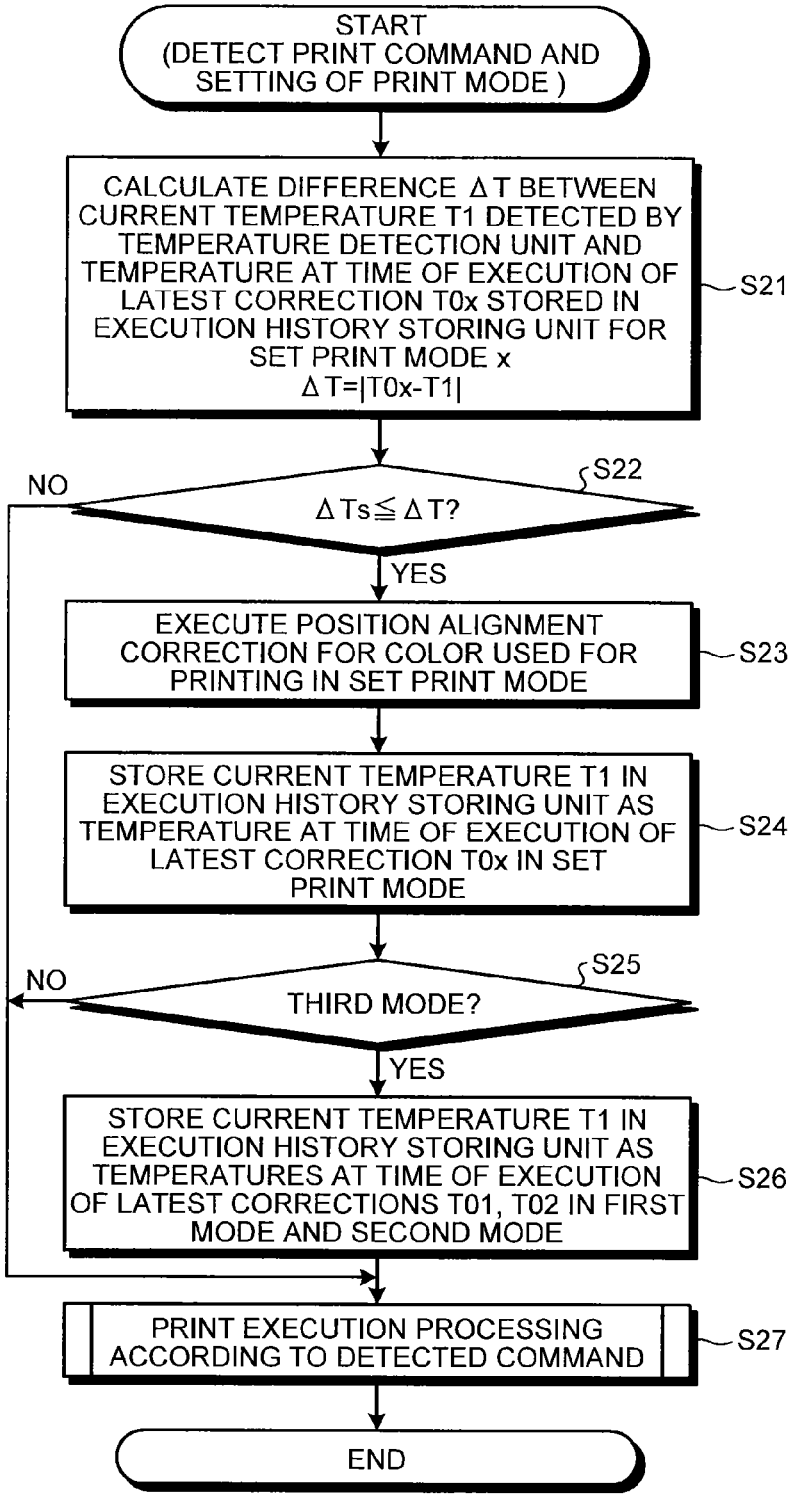
FIG. 9 is a flowchart illustrating processing related to position alignment correction according to the second example.

Second Example of Position Alignment Correction Necessity Determination: FIGS. 7 to 9

Subsequently, the second example of the position alignment correction necessity determination with the position alignment timing setting unit 63 will be explained. Together with this, the management method of the history with the execution history storing unit 64 will also be explained. The first example relates to a case where the image forming apparatus 10 includes four image-forming units for YMCK.

FIG. 7 illustrates an example of history stored in an execution history storing unit according to the second example.

In this second example, the first to third modes are provided, in which a combination of colors used for printing is different from each other. Then, the temperatures detected by the temperature detection unit 66 when the position alignment corrections for the colors were done last time are respectively stored as temperatures at the time of execution of the latest corrections T01 to T03.

The colors used in the modes are as illustrated in FIG. 8. The first mode is a red and black mode using three colors of YMK. The second mode is a green single-color mode using two colors of YC. The third mode is a full-color mode using four colors of YMCK.

In this case, the combination of the colors used in the third mode includes all of the colors used in both the first mode and the second mode. For this reason, the result of the positional deviation correction performed for the combination of the colors used in the third mode can also be used for the printing in the first mode and the second mode. This is because the positional deviation correction is executed for the combination including all of the colors used in the mode.

Accordingly, the position alignment correction performed in the third mode is also treated as the position alignment correction performed in the first mode and the second mode, and the temperature detected by the temperature detection unit 66 when the position alignment correction is performed in the third mode is stored in the execution history storing unit 64 as the temperature at the time of execution of the latest correction not only in the third mode but also in the first mode and the second mode.

More specifically, on the basis of the mode in which the position alignment correction is performed, all the modes to which the parameters representing the image formation environment during execution of the correction in the mode can be applied are identified, and the parameters representing the image formation environment during execution of the correction are stored in association with the modes to which the parameters can be applied.

In the first mode and the second mode, the combination of colors used in the mode does not include all the colors used in another mode. Therefore, the result of the positional deviation correction performed in the first mode and the second mode cannot be used for printing in another mode.

Subsequently, FIG. 9 illustrates a flowchart of processing related to position alignment correction executed by the CPU 11 according to the second example. This processing is processing corresponding to the functions of the engine control unit 61 and the position alignment timing setting unit 63.

When the CPU 11 detects a print command and setting of print mode used for printing according to the print command, the CPU 11 starts processing as illustrated in the flowchart of FIG. 9.

Then, first, a difference ΔT between the current temperature T1 detected by the temperature detection unit 66 and the temperature at the time of execution of the latest correction T0x stored in the execution history storing unit 64 for the set print mode x is calculated (S21). The following expression holds: $\Delta T=|T0x-T1|$.

Then, a determination is made as to whether $\Delta Ts \leq \Delta T$ holds or not (S22). ΔTs is a threshold value stored in the threshold value storage unit 65.

The determination in step S22 corresponds to the determination as to whether the latest position alignment correction is executed in the mode in which all the colors used in the currently set mode are used, and the change of the image formation environment from when the latest correction was executed to the present moment is within a predetermined range. This is because when this condition is satisfied, it can be determined that the positional deviation does not occur after the correction is made by the latest position alignment correction regarding the combination of colors used in the currently set print mode. As described above, the latest correction may not be necessarily done in the same mode as the currently set print mode.

When NO in step S22, the latest position alignment correction is executed in the mode using all the colors used in the currently set mode, and the change of the image formation environment from when the latest correction was executed to the present moment is within the predetermined range, and therefore, it is determined that it is not necessary to perform the position alignment correction at the present moment, and the print execution processing according to the detected print command is performed (S27), and then, the processing is terminated.

On the other hand, when YES in step S22, the latest position alignment correction was not done for the combination of colors used in the set print mode, or the temperature has changed greatly from when the latest position alignment correction was performed to the present moment, and accordingly, the positional deviation may occur.

Therefore, the position alignment correction is executed for the colors used for printing in the set print mode (S23). This correction is the same as in step S14 of FIG. 6 after it is determined for which color the correction is performed, but the reference color is not particularly defined. The positions are aligned between all the colors for which the correction is performed. This is to make it possible to cope with a case where there is no color that is commonly used in all the modes, though Y is used in all the modes in the example of FIG. 8.

Then, when the position alignment correction is finished, the current temperature T1 detected by the temperature detection unit 66 is stored in the execution history storing unit 64 as the temperature at the time of execution of the latest correction T0x in the set print mode (S24).

Thereafter, a determination is made as to whether the set mode is the third mode or not (S25). If YES, the current temperature T1 detected by the temperature detection unit 66 is stored in the execution history storing unit 64 as the temperatures at the time of execution of the latest corrections T01, T02 in the first mode and the second mode as explained in the explanation about FIG. 8 (S26).

Thereafter, the print execution processing (S27) is performed. When NO in step S25, the print execution processing is performed without any further processing.

In the above processing, steps S21 and S22 are the processing corresponding to the function of the determination unit, and steps S24 to S26 are the processing corresponding to the function of the storing unit.

According to the above processing, a determination is made as to whether the position alignment correction is needed or not on the basis of steps S21 and S22, whereby the case where printing is affected by the deviation can be appropriately determined in accordance with the combination of colors used for printing and the degree of change of the image formation environment from when the correction was executed in the past, so that the positional deviation correction can be done appropriately. Therefore, like the first example, the toner and the time required for the position alignment correction can be reduced.

Figures 10, 11:
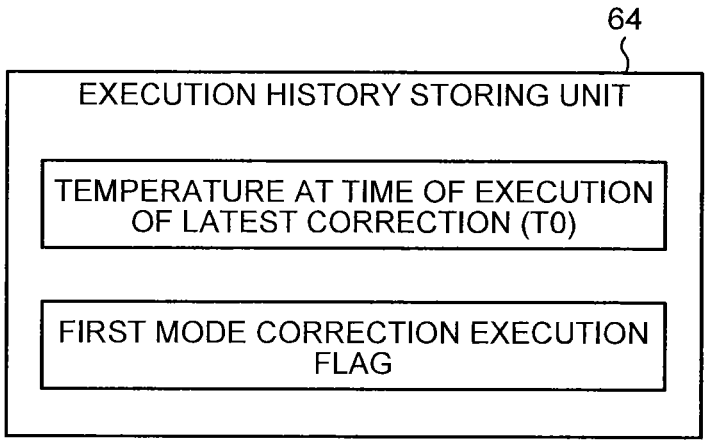
FIG. 10 is a figure illustrating an example of history stored in an execution history storing unit according to a third example of position alignment correction necessity determination.
FIG. 11 is a figure illustrating prepared print modes in the third example.
Figure 12:
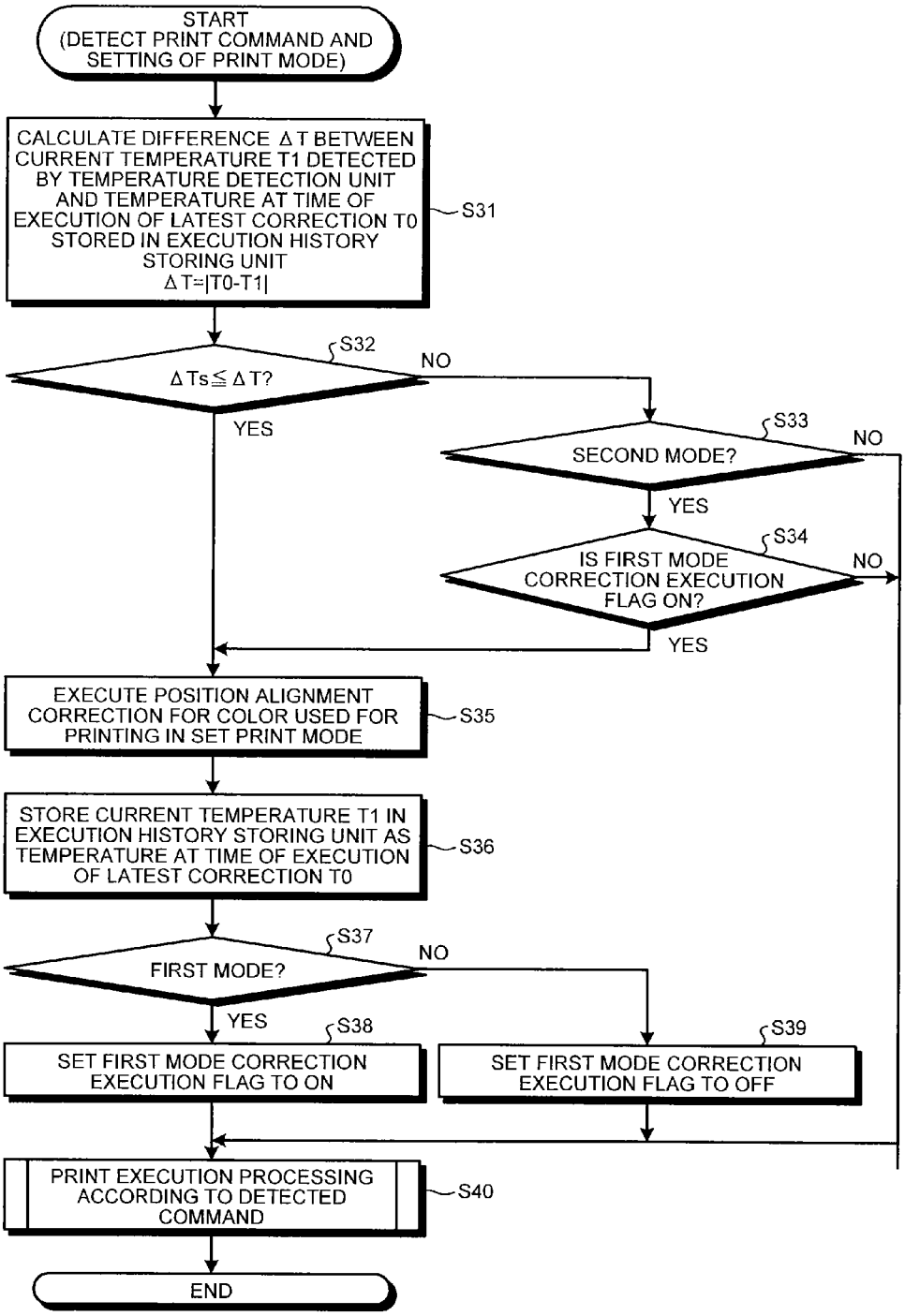
FIG. 12 is a flowchart illustrating processing related to position alignment correction according to the third example.

Third Example of Position Alignment Correction Necessity Determination: FIGS. 10 to 12

Subsequently, the third example of the position alignment correction necessity determination with the position alignment timing setting unit 63 will be explained. Together with this, the management method of the history with the execution history storing unit 64 will also be explained. The third example relates to a case where the image forming apparatus 10 includes five image-forming units for YMCKS.

FIG. 10 illustrates an example of history stored in an execution history storing unit according to the third example.

In this third example, the first and second modes are provided, in which a combination of colors used for printing is different from each other. However, the execution history storing unit 64 stores, in a common storage region without distinguishing the mode, the temperature detected by the temperature detection unit 66 during the last position alignment correction as the temperature at the time of execution of the latest correction T0. In addition, a first mode correction execution flag is also stored. The first mode correction execution flag indicates whether the print mode in which the position alignment correction was done most recently is the first mode or not. When the flag is ON, the print mode in which the position alignment correction was done most recently is the first mode. When the flag is OFF, the print mode in which the position alignment correction was done most recently is not the first mode.

The colors used in the modes are as illustrated in FIG. 11. The first mode is a full-color mode using four colors of YMCK. The second mode is a full-color+special color mode using five colors of YMCKS.

In this case, the number in colors used in the second mode is more than that in the first mode, and the combination of colors used in the second mode includes the combination of colors used in the first mode. For this reason, the result of the positional deviation correction performed for the combination of the colors used in the second mode can also be used for the printing in the first mode. This is because the positional deviation correction is executed for the combination including all of the colors used in the mode.

The concept of the third example is the same as that of the second example in that such use of the positional deviation correction in another mode is made possible. However, the temperature at the time of execution of the latest correction is stored in such a manner that only one common value for both of the modes is stored, and the flag indicating the print mode in which the latest position alignment correction was performed is stored, so that this reduces the amount of data stored in the execution history storing unit 64.

Subsequently, FIG. 12 illustrates a flowchart of processing related to position alignment correction executed by the CPU 11 according to the third example. This processing is processing corresponding to the functions of the engine control unit 61 and the position alignment timing setting unit 63.

When the CPU 11 detects a print command and setting of print mode used for printing according to the print command, the CPU 11 starts processing as illustrated in the flowchart of FIG. 12.

Then, first, a difference ΔT between the current temperature T1 detected by the temperature detection unit 66 and the temperature at the time of execution of the latest correction T0 stored in the execution history storing unit 64 is calculated (S31). The following expression holds: $\Delta T=|T0-T1|$.

Then, a determination is made as to whether $\Delta Ts \leq \Delta T$ holds or not (S32). ΔTs is a threshold value stored in the threshold value storage unit 65.

When YES, it is determined that the position alignment correction is necessary irrespective of the set print mode. This is because the temperature has greatly changed from when the latest position alignment correction was executed to the present moment, and accordingly, positional deviation may occur.

On the other hand, even when NO, it cannot be immediately determined that the position alignment correction is unnecessary. Accordingly, a determination is made as to whether the set mode is the second mode or not (S33).

When NO, more specifically, when the first mode is set, then, the result in the mode when the position alignment correction was executed last time can be used as long as the temperature does not change greatly irrespective of whether the mode when the position alignment correction was executed last time is either the first mode or the second mode. Therefore, the position alignment correction is determined to be unnecessary, and the print execution processing according to the detected print command is performed (S40), and the processing is terminated.

When YES in step S33, more specifically, when the second mode is set, a determination is made as to whether the first mode correction execution flag stored in the execution history storing unit 64 is ON or not (S34). When NO, it is understood that the mode in which the position alignment correction was executed last time is the second mode and the temperature has not changed greatly, and therefore, the result at that moment can be used, and accordingly, the position alignment correction is determined to be unnecessary, and the processing proceeds to the print execution processing according to the detected print command (S40).

On the other hand, when YES in step S34, it is understood that the mode in which the position alignment correction was executed last time is the first mode and even if the temperature has not changed greatly, the correction for S color is not executed, and therefore, the result cannot be used. Therefore, the position alignment correction is determined to be necessary.

Then, even when YES in step S32 or YES in step S34, the position alignment correction is executed for the color used for printing in the set print mode (S35). This correction is the same as in step S14 of FIG. 6 after it is determined for which color the correction is performed, but the reference color is not particularly defined. The positions are aligned between all the colors for which the correction is performed. This concept is the same as in the second example.

Then, when the position alignment correction is finished, the current temperature T1 detected by the temperature detection unit 66 is stored in the execution history storing unit 64 as the temperature at the time of execution of the latest correction T0 in the set print mode (S36). When the set print mode is the first mode (YES in S37), the first mode correction execution flag is set to ON (S38). When the set print mode is the second mode (NO in S37), the first mode correction execution flag is set to OFF (S39).

In any case, the processing thereafter proceeds to the print execution processing (S40).

In the above processing, steps S31 to S34 are the processing corresponding to the function of the determination unit, and steps S36 to S39 are the processing corresponding to the function of the storing unit.

According to the above processing, a determination is made as to whether the position alignment correction is needed or not on the basis of steps S31 to S34, whereby the case where printing is affected by the deviation can be appropriately determined in accordance with the combination of colors used for printing and the degree of change of the image formation environment from when the correction was executed in the past, so that the positional deviation correction can be done appropriately. Therefore, like the first example, the toner and the time required for the position alignment correction can be reduced. Further, by suppressing the amount of data stored in the execution history storing unit 64, it becomes possible to save the memory and simplify the control.

The determination in steps S32 to S34 corresponds to, as a whole, the determination as to whether the latest position alignment correction is executed in the mode using all the colors used in the currently set mode, and whether the change of the image formation environment from when the latest correction was executed to the present moment is within a predetermined range or not. Then, when this is YES, the processing proceeds to step S35, and when NO, the processing proceeds to step S40.

Figure 13:
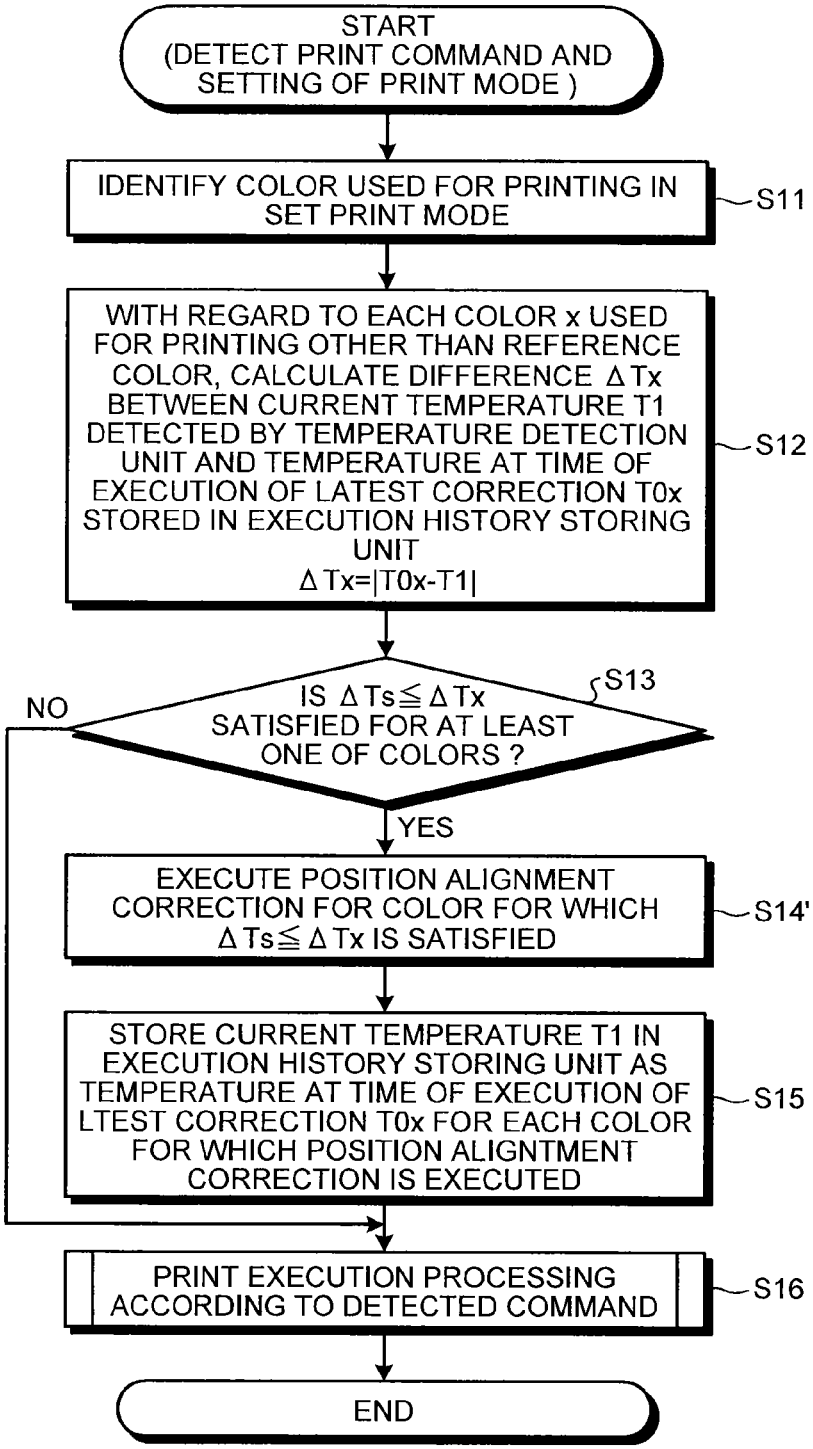
FIG. 13 is a flowchart illustrating processing related to position alignment correction according to a fourth example of position alignment correction necessity determination.

Fourth Example of Position Alignment Correction Necessity Determination: FIG. 13

Subsequently, the fourth example of the position alignment correction necessity determination with the position alignment timing setting unit 63 will be explained. This fourth example is a variation of the first example, and therefore, only the difference will be explained.

FIG. 13 illustrates a flowchart of processing related to position alignment correction executed by the CPU 11 according to the fourth example.

This processing is different from the processing of FIG. 6 only in the feature that S14' is performed instead of step S14 of FIG. 6.

More specifically, the position alignment correction is executed not for all the colors used for printing in the set print mode, but is executed for the color for which $\Delta Ts \leq \Delta Tx$ is satisfied in step S13. More specifically, the position alignment correction is executed for a color for which change of the image formation environment from when the latest correction for the color was executed to the present moment is out of a predetermined range, among the colors used for printing other than the reference color.

This is because, for a color not satisfying $\Delta Ts \leq \Delta Tx$ in step S13, the result of the position alignment correction that was done in the past can be used, and therefore, it can be determined that the position alignment correction is not required to be done again at the moment of this processing.

In this case, step S13 is the processing corresponding to the function of identifying unit.

By doing so, the colors for which the position alignment correction is done can be narrowed down as compared with the first example, and the toner and the time required for the position alignment correction can be reduced.

The explanation about the embodiment is finished here. However, in this invention, the specific configuration of each unit, the contents of processing, the provided print mode, the format of data, the specific contents of the position alignment correction, specific algorithm of the position alignment necessity determination, and the like are not limited to what has been explained in the embodiment.

For example, in the above embodiment, the example in which the position alignment correction is done before the execution of the print job (JOB) of the print command has been explained. However, in addition thereto, or in place thereof, the position alignment correction may be done during execution or after execution of the job.

In this case, the processing of FIG. 6 and the like may be executed with appropriate timing during execution or after execution of the job. In this way, by performing the position alignment correction as necessary at all times, high image quality can be maintained.

Figure 14:
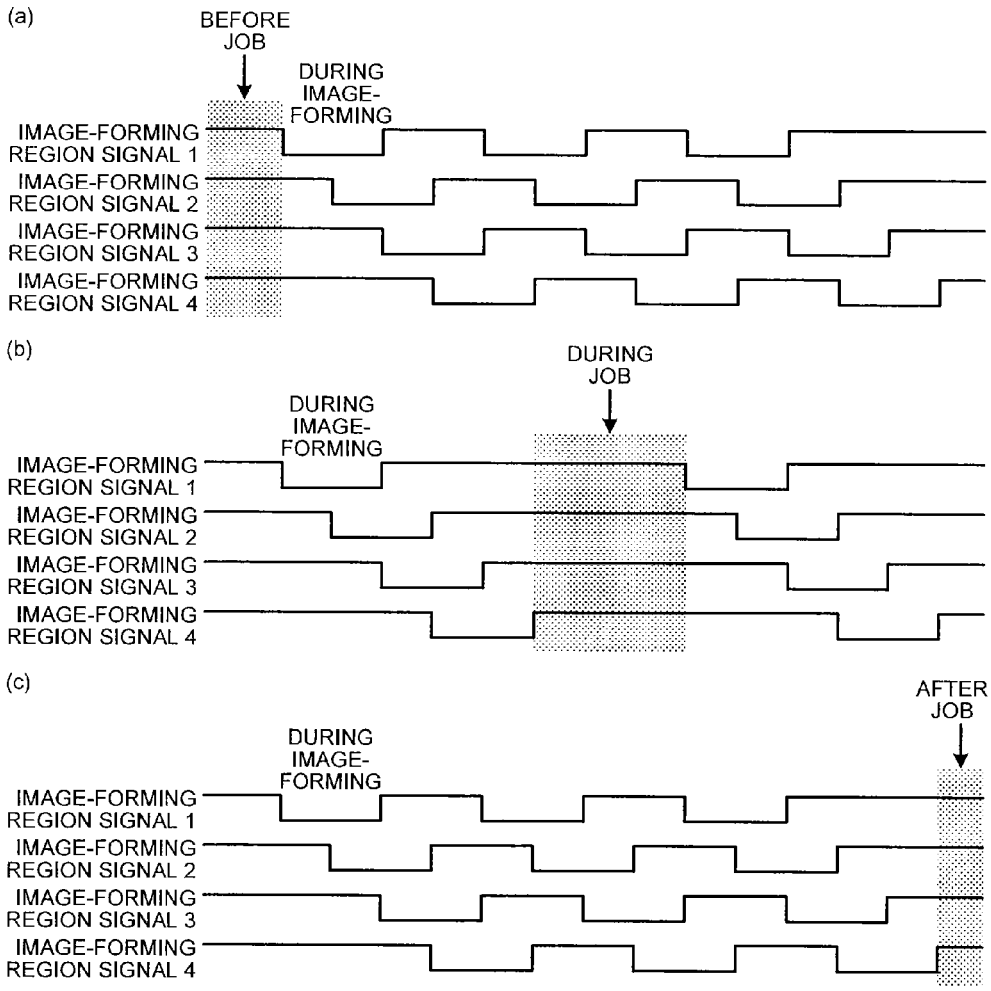
FIG. 14 is a figure for explaining timing of before execution of a job, during execution, after execution.

FIG. 14 illustrates a timing chart, and the timing with which each image-forming unit 30 is caused to form an image is controlled by image-forming region signals associated with the image-forming units 30. What is illustrated in FIG. 14 is an example of an apparatus having four image-forming units 30.

The term "before execution of job" means a time before the image-forming region signal becomes active (low level) for any of the colors as illustrated in FIG. 14(*a*). The term "during execution of job" means a time from when the image-forming region signal once becomes active for each color and to when it becomes active again subsequently as illustrated in FIG. 14(*b*). One active period corresponds to image-forming for one page. The term "after execution of job" means a time after all the active periods of the image-forming region signals according to the print job have been finished as illustrated in FIG. 14(*c*).

In the above embodiment, an example where the temperature is considered as the image formation environment has been explained. However, in addition to or in place of the temperature, another condition may be considered. Instead of directly measuring the image forming condition, it may be possible to deem that the image forming condition has changed by a threshold value or more when a certain period of time passes.

Those to which this invention is applied is not limited to a tandem-type electrophotography color image forming apparatus. This invention can also be applied to a revolver type, and can also be applied to an image forming apparatus of a type not using any intermediate transfer belt. In this case, in the position alignment processing, the image-forming position on the sheet is aligned. It is to be understood that this invention can also be applied to position alignment in an image forming apparatus forming an image according to a method other than the electrophotography type, such as inkjet.

It is to be understood that the configuration of each embodiment, operation example, and modification explained above can be carried out with any combination as long as they are not contradictory to each other.

According to the above configuration, the time and the image forming materials required for position alignment of images of multiple colors can be reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprises:

image-forming units of multiple colors that form images on an image carrier in such a manner that the images are overlaid on one another, and a determination unit that determines necessity of position alignment correction of an image of each color accompanying image formation in accordance with a degree of change of image formation environment from when correction was executed in the past and a combination of colors used for the image formation.

2. The image forming apparatus according to claim 1, wherein the position alignment correction is to align a position of an image of a color used for the image formation other than a reference color among the multiple colors with a position of an image of the reference color as a reference, and the image forming apparatus comprises a storing unit that stores execution history of the position alignment correction of an image, wherein when the determination unit determines that change of image formation environment from when the latest correction for the color was executed to the present moment is within a predetermined range for all colors used for the image formation other than the reference color among the colors on the basis of the history stored in the storing unit, the determination unit determines that the position alignment correction is unnecessary.

3. The image forming apparatus according to claim 2, wherein the storing unit stores, as the history, a color for which the position alignment correction is performed and a parameter representing image formation environment during execution of correction in association with each other.

4. The image forming apparatus according to claim 1 comprising a storing unit that stores execution history of the position alignment correction of an image, wherein the image forming apparatus has a plurality of modes that are different in a combination of colors used for image formation, and when the determination unit determines, based on the history stored in the storing unit, that the latest position alignment correction is executed in a mode in which all colors used in a currently set mode are used and that change of image formation environment from when the latest correction was executed to the present moment is within a predetermined range, then the determination unit determines that the position alignment correction is unnecessary.

5. The image forming apparatus according to claim 4, wherein the storing unit identifies, on the basis of a mode in which the position alignment correction is performed, all modes to which a parameter indicating image formation environment during execution of the correction in the mode can be applied, and stores the parameter indicating the image formation environment during execution of the correction in association with each mode to which the parameter can be applied.

6. The image forming apparatus according to claim 4, wherein the storing unit stores, as the history, a parameter indicating image formation environment during execution of the correction in a common storage region regardless of a mode in which the position alignment correction is performed, and stores a flag indicating the mode in which the position alignment correction is performed last time.

7. The image forming apparatus according to claim 2 comprising an identifying unit that identifies, from among colors used for the image formation other than the reference color, a color for which change of image formation environment from when the latest correction for the color was executed to the present moment is out of a predetermined range, on the basis of the history stored in the storing unit, wherein the position alignment correction is performed for a color identified by the identifying unit from among colors used for image formation other than the reference color.

8. An image forming method comprises:

forming images of multiple colors on an image carrier in such a manner that the images are overlaid on one another, and determining necessity of position alignment correction of an image of each color accompanying image formation in accordance with a degree of change of image formation environment from when correction was executed in the past and a combination of colors used for the image formation.

9. An image forming apparatus comprises:

means for forming images of multiple colors on an image carrier in such a manner that the images are overlaid on one another, and a means for determining necessity of position alignment correction of an image of each color accompanying image formation in accordance with a degree of change of image formation environment from when correction was executed in the past and a combination of colors used for the image formation.

* * * * *